US005735573A

United States Patent [19]

Vredevoogd

[11] Patent Number: 5,735,573

[45] Date of Patent: Apr. 7, 1998

[54] CHAIR WITH POWER SEAT

[76] Inventor: Jon D. Vredevoogd, 2123 Beacon Hill Rd., Lansing, Mich. 48906-3602

[21] Appl. No.: 699,771

[22] Filed: Aug. 20, 1996

[51] Int. Cl.[6] ..... A47C 15/00

[52] U.S. Cl. ..... 297/257; 297/232; 297/188.01; 297/188.14; 297/188.19; 297/330; 297/452.18; 297/452.24

[58] Field of Search ..... 297/257, 232, 297/344.1, 330, 188.14, 188.19, 188.04, 452.18, 451.9, 188.01

[56] References Cited

U.S. PATENT DOCUMENTS

| | | | |
|---|---|---|---|
| 1,427,583 | 8/1922 | Davis | 297/188.14 X |
| 1,803,947 | 5/1931 | Runkles et al. | 297/188.14 X |
| 2,251,544 | 8/1941 | Jiranek . | |
| 2,310,366 | 2/1943 | Harman . | |
| 2,346,629 | 4/1944 | Travers | 297/188.01 X |
| 2,427,234 | 9/1947 | Shepherd . | |
| 2,446,185 | 8/1948 | Masucci et al. . | |
| 2,494,838 | 1/1950 | Slaughter . | |
| 2,646,839 | 7/1953 | Hillman . | |
| 2,648,910 | 8/1953 | Brown . | |
| 2,920,684 | 1/1960 | Fante et al. . | |
| 2,924,265 | 2/1960 | Himka | 297/330 |
| 3,147,038 | 9/1964 | Barabas . | |
| 3,203,732 | 8/1965 | Hoffmann . | |
| 4,191,420 | 3/1980 | Fassett et al. | 297/188.19 X |
| 4,616,874 | 10/1986 | Pietsch et al. . | |
| 4,648,654 | 3/1987 | Voss . | |
| 4,854,456 | 8/1989 | Lee | 211/123 X |
| 5,064,244 | 11/1991 | Sproule | 297/257 X |
| 5,106,153 | 4/1992 | Darling | 297/232 |
| 5,282,671 | 2/1994 | Funk . | |
| 5,284,380 | 2/1994 | Gehry | 297/451.9 |
| 5,288,131 | 2/1994 | Singley | 297/452.24 |
| 5,326,153 | 7/1994 | Muffi | 297/232 |
| 5,335,962 | 8/1994 | Gera | 297/232 |
| 5,344,216 | 9/1994 | Suominen . | |
| 5,346,285 | 9/1994 | West, III | 297/452.18 |
| 5,360,255 | 11/1994 | Cook et al. | 297/232 |
| 5,373,950 | 12/1994 | Marc | 211/123 X |
| 5,474,359 | 12/1995 | Muffi | 297/232 X |
| 5,480,213 | 1/1996 | Sproule | 297/232 |
| 5,527,092 | 6/1996 | Cook et al. | 297/232 |
| 5,529,380 | 6/1996 | Blansett | 297/452.18 |

*Primary Examiner*—Peter M. Cuomo
*Assistant Examiner*—Rodney B. White
*Attorney, Agent, or Firm*—Price, Heneveld, Cooper, DeWitt & Litton

[57] ABSTRACT

A home seating furnishing having one or more power driven adjustable seats, where each seat offers movement independent from all other seats in the furnishing is disclosed. The furnishing includes an armrest lid which is moveable between open and closed positions while remaining horizontal at all times, thereby allowing exposure of the interior of the arm rest.

16 Claims, 3 Drawing Sheets

CHAIR WITH POWER SEAT

FIELD OF THE INVENTION

The invention relates to home and office seating units, in particular armchairs, sofas, and loveseats with adjustable seats.

BACKGROUND OF THE INVENTION

There has been extensive research and development of seating in the automobile industry which has incorporated ergonomics and computers. However, very little has been done to incorporate such technology into home and office furnishings. Advancements in adjustable seating for home and office furniture have not included means for providing the full range of motions provided by the automobile seat.

Home chairs and other motion furniture have included power operated mechanisms to adjust the seat from an upright to a reclined position or vice versa. Other motion furniture have used intricate gear mechanisms or mechanical sliding systems to adjust the seat or back; however, these furnishings have not provided the ease and convenience of the automotive power driven adjustable seating.

Power driven adjustable seats have been used in vehicles to provide a variety of directions of motion. However, such technology has not been adapted for use in home furnishings. To incorporate this technology into home and office seating requires a new framing system which will accommodate an automotive power seat unit. Seats for vehicles do not provide armrests attached directly to the base of the seat, nor do they suggest or permit multiple seats on a single frame with independently adjustable seats.

Home seating furnishings have also been equipped with an armrest having a hinged lid to permit use of the armrest as a receptacle for storage. However, such lids do not remain horizontal at all times, but rotate to an adjacent position about a hinge on the outer edge of the armrest. Because the lids do not remain horizontal, they cannot be used as support surfaces when the lid is open or is being opened. Others have utilized a pivotally mounted armrest that can be moved for easier entry to the chair structure. Other known furniture have used a raisable armrest which allows access to the interior of the armrest only from the inner side of the armrest. These configurations do not provide the user with an adequate means to continue to utilize the lid as a horizontal support surface while the lid is being moved, or even after the lid is moved to its new position, while using the armrest as a storage area.

SUMMARY OF THE INVENTION

The present invention provides home seating furnishings that utilize a power unit that will allow the adjustment of each seat independent from the other seats, and also, if desired, independent from the back. As such, the general objective of the present invention is to provide a seating frame designed to incorporate a power unit which allows adjustable seats where each seat can be moved independently in a variety of directions. To achieve the above objective, the invention includes a base on the underside of the invention where the armrests and power unit are attached. A seat is attached to the power unit, where the seat is in roughly a horizontal position. A back is attached to both armrests, thereby further stabilizing the armrests, or attached to the seat.

In a preferred embodiment, an automobile power seat unit provides the advantage of movement in two directions (forward and backward), four directions (forward and backward, and up and down), six directions (forward and backward, up and down, and front end up and front end down), or eight directions (forward and backward, up and down, front end up and front end down, and back end up and back end down), depending on the power unit that is selected. Each seat in a multi-seat unit can thus be moved independently from the other seats in the unit. Because the back may be attached to the framework and not necessarily to the seat, one embodiment provides the advantage of movement of the seat by a power unit independent of any movement of the back.

Another aspect of the invention includes a lid covering each armrest that can be displaced to an adjacent position, thereby exposing the interior of the respective armrest. The armrest lids are attached to the armrests by a double pivot hinge using a parallelogram relationship to allow access to the interior of the armrests, thereby allowing storage in the interior of the armrests. The double pivot hinge allows the lid to remain parallel to the floor while it is being moved and also in its adjacent position to the armrest.

Another advantage of the present invention is the utilization of steel or high strength composite materials in the construction of the frames while maintaining a traditional aesthetic. The frames can be constructed of cut and bent metal sheets that are preferably welded together, and/or constructed of high strength composites (e.g., epoxy or polyester resin composites) which are joined together such as with adhesives. This construction acts as a single unit which is strong, durable, light in weight, and which will not loosen over an extended period of time.

These and other features, objects and advantages of the present invention will become apparent upon reading the following description thereof together with reference to the accompanying drawings.

DESCRIPTION OF THE PREFERRED EMBODIMENTS

Figure 1:
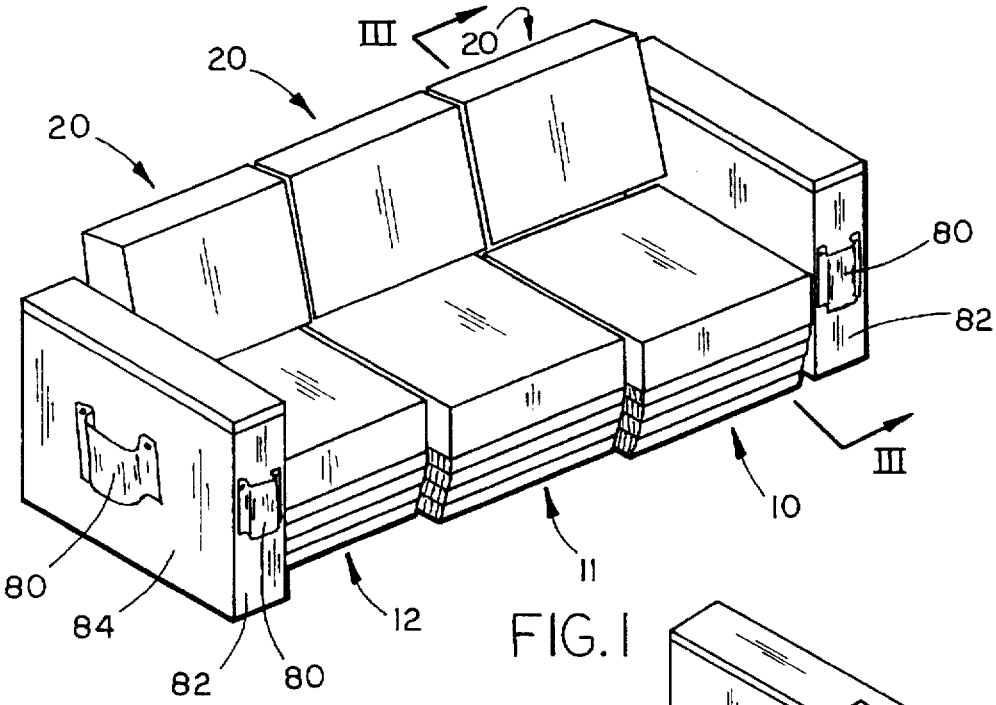
FIG. 1 is a perspective view of a multiple seating unit.
Figure 3:
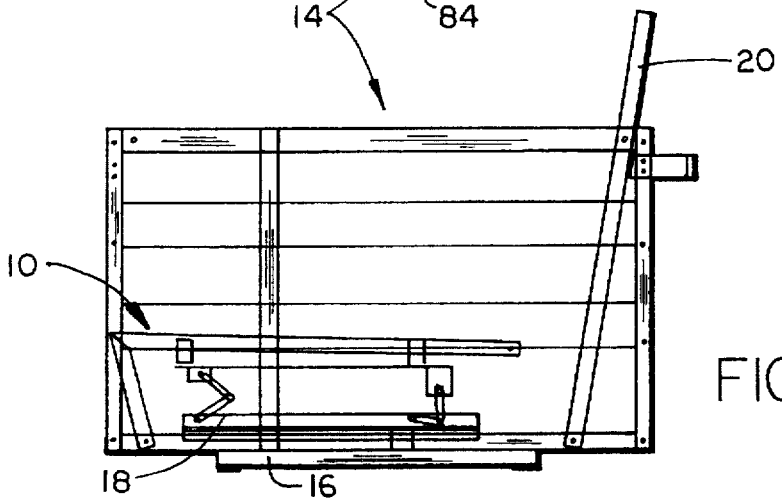
FIG. 3 is a cross-sectional view taken along lines 3—3.

As used herein, the term "chair" includes chair, sofa, couch, loveseat and any other home seating furnishing. Other terms not specifically identified herein may be used to refer to similar structures and functions and are contemplated to be considered within the scope of this invention. Referring now to the drawings, FIG. 1 shows the exterior features of the preferred embodiment, where the chair includes a plurality of seats 10, 11, and 12, armrests pedestals 14, and backs 20. As seen in FIG. 3, the chair also includes a base 16 and a power unit 18.

Figure 6:
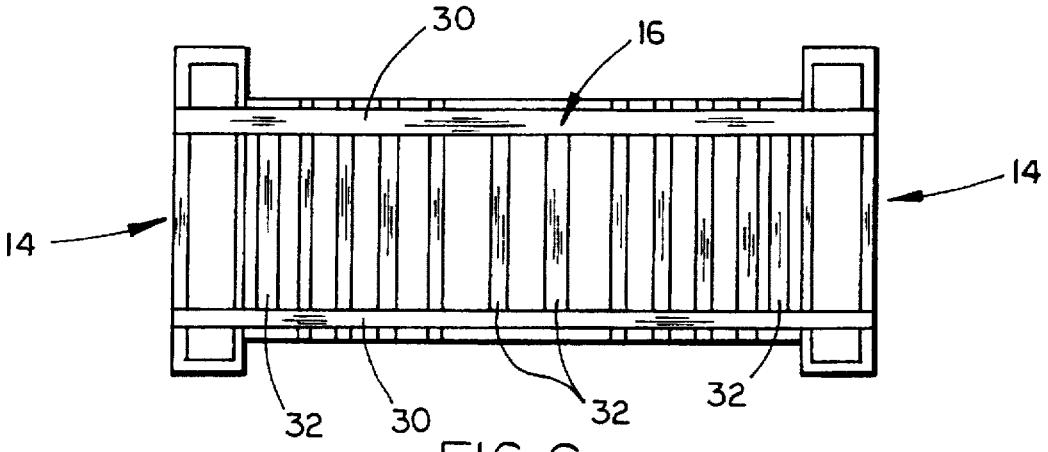
FIG. 6 is a bottom view of the invention.

As seen in FIG. 6, base 16 includes two longitudinal floor channels 30 extending the full length of the chair, and at least two transverse power unit mounts 32. Transverse power unit mounts 32 are mounted perpendicular to and on the top of floor channels 30.

Figure 7:
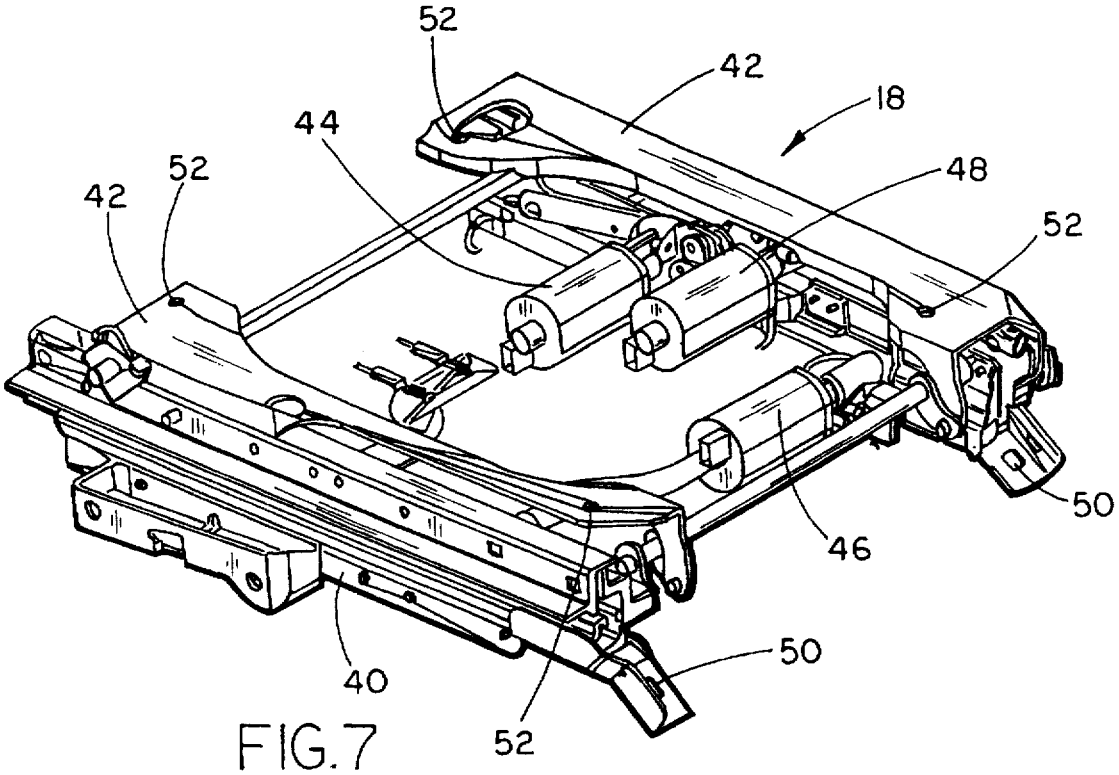
FIG. 7 is a perspective view of a commonly available power unit which can be used for movement of the seat.
Figure 8:
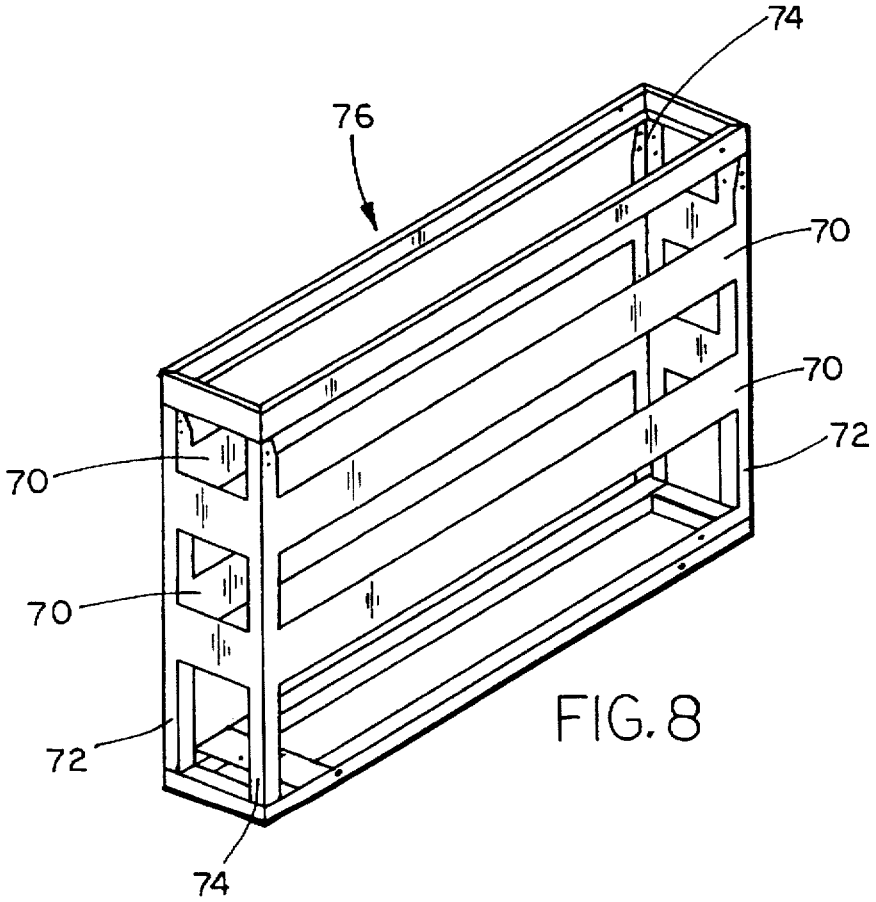
FIG. 8 is a perspective view of an armrest pedestal frame.

FIG. 3 shows the chair with a commercially available power unit 18 (FIG. 7) mounted to base 16. Power unit 18 is the type used in an automobile seat and includes one or more bottom mounting brackets 40, two top mounting shelves 42, and one or more electric motors, 44, 46 and 48. Bottom mounting brackets 40 define a plurality of holes 50 for mounting power unit 18 to transverse power unit mounts 32 (FIG. 6) by bolts or other means of attachment. Top mounting shelves 42 define holes 52 near each respective corner of power unit 18 which permit the bolting of seat 10 to the top of power unit 18. Electric motors 44, 46 and 48 provide vertical, horizontal and tilting movement of the seat 10. Seat 10 is supported by power unit 18 which provides the movement of seat 10.

Figure 4:
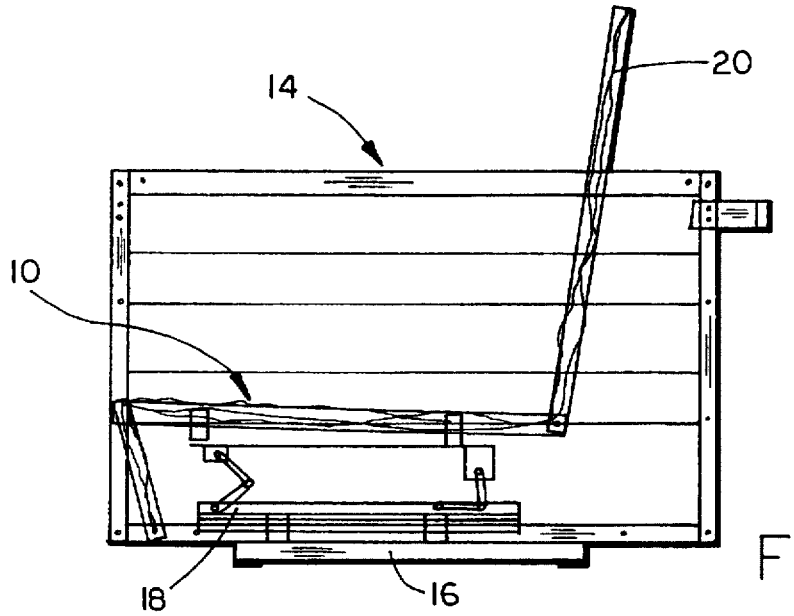
FIG. 4 is an alternate cross-section view taken along lines 3—3.

As shown in FIGS. 3 and 4, the preferred embodiment may include a back 20. The embodiment may define a framework for supporting power units which provide adjustable seats 10, 11, 12. The framework includes a base 16, armrest pedestals 14, and optionally one or more additional stabilizing members or throwbars 60 (FIG. 2) connected at opposite ends thereof to the armrest pedestals 14. Back 20 can be adjustably or fixedly attached to the framework, thereby providing seat movement independent of the back. Alternatively, back 20 can be adjustably or fixedly attached to seat 10.

The armrest pedestals 14 and other parts of the frame, such as the back and the seat, may be constructed of a "uniframe" construction, such as by cutting and bending of one or more, and preferably two, sheets of metal. Flat sheets of metal are first cut to include horizontal member portions 70 and vertical supports 72 and 74. In a preferred embodiment, each sheet is cut to include two end vertical supports 72 and an intermediate vertical support 74 which is close to one end. One sheet is cut to include intermediate vertical support 74 a short distance from one end, while another sheet should include an intermediate vertical support 74 the same distance from the opposite end of the first support. Each cut metal sheet is then bent 90°, in opposite directions from each other, along intermediate vertical support 74, thereby creating a long and a short side. The two oppositely formed, cut and bent sheets are then attached by welding, pop-riveting or bolting to form a parallelepiped-shaped armrest pedestal frame 76. The frames may also be constructed of composite resins, such as epoxy or polyester resin composites. The composites can be formed into one or more pieces which can be secured together by adhesives. Such a construction provides an armrest pedestal which has no parts that can loosen up over time, especially if the parts are welded together. Such a construction also reduces labor and expense.

Figure 2:
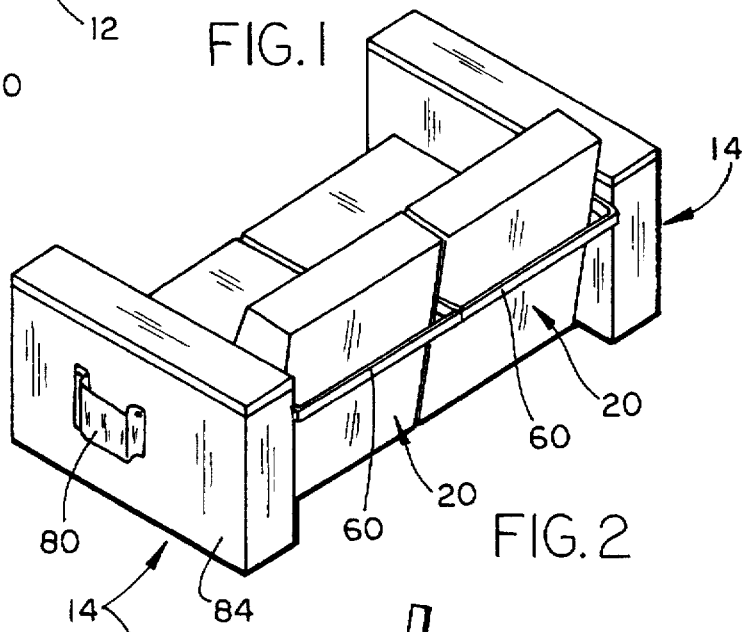
FIG. 2 is a perspective rear view of a multiple seating unit.

As seen in FIG. 6, armrest pedestals 14 are mounted on opposite ends of base 16 and substantially orthogonally to longitudinal floor channels 30. Armrest pedestals 14 can be further secured by attachment of one or more backs 20 (FIG. 2) or, if backs 20 are attached to seats 10, 11, 12 and not arm rest pedestal 14, by the attachment of one or more throwbars 60, as seen in FIG. 2. Throwbars 60 are preferably made of metal, and serve the purpose of additionally stabilizing the armrest pedestals 14 while at the same time are spaced a sufficient distance from back 20 to act in conjunction with the back as a beam and allow the hanging of blankets, commonly called throws, over them. Armrest pedestals 14 may also include one or more pockets 80 attached on either the armrest front 82 or armrest sides 84 or both. Pockets 80 serve as storage areas for the user.

Seats 10, 11, 12 and back 20 may be covered in cushions to make the seating arrangement more comfortable for the user. Seats 10, 11, 12, back 20 and armrest pedestals 14 are generally covered in upholstery to enhance the aesthetic appearance of the chair. One embodiment involves the design of new furniture frames and assemblies to accommodate the power units, computers and the like. These frames can accommodate the necessary storage and electronics for remote controls, laptop computers, joy sticks and the like. In addition, these storage units can be powered and locked.

Figure 5:
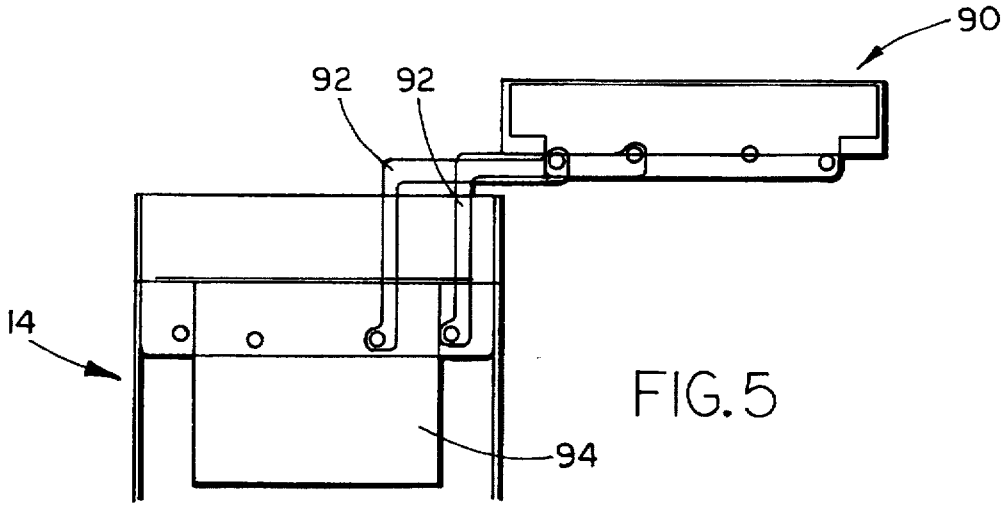
FIG. 5 is a fragmentary front view of the armrest and lid to the armrest.

FIG. 5 shows a movable armrest lid 90. Lid 90 is attached to armrest 14 by a pair of L-shaped pivot hinges 92 on either side of armrest 14. Pivot hinges 92 are of substantially equal size and shape, and are attached a certain distance apart on the inside of armrest 14, and are also attached to lid 90 the same distance apart as on armrest 14. This creates a parallel positioning of pivot hinges 92. Pivot hinges 92 allow movement of lid 90 to an adjacent position, thereby exposing armrest interior 94. Because pivot hinges 92 allow movement of lid 90 to a position adjacent to armrest 14, this feature allows the user full use of armrest interior 94 for storage or other use. The parallel nature of pivot hinges 92 maintain the horizontal nature of lid 90 at all times, even during movement to its adjacent position. The "L" shape of the pivot hinge allows the lid to be positioned immediately adjacent to the arm opening at the same elevation when the lid is open as when it is closed, with clearance.

It will become apparent to those skilled in the art that various modifications to the preferred embodiment of the invention as described herein can be made without departing from the spirit or scope of the invention as defined by the appended claims.

The embodiments of the invention in which an exclusive property or privilege is claimed are defined as follows:

1. An article of furniture comprising:

a base;

two armrest pedestals attached to and extending upwardly from opposite ends of the base;

a power unit mounted on the base; and a seat attached to the power unit, the power unit providing selective, independent forward and rearward movement of said seat relative to the base and armrest pedestals, providing independent angular movement about a horizontal axis near a rear of the seat and providing independent angular movement about a horizontal axis near a front of the seat.

2. An article of furniture according to claim 1 wherein the article of furniture includes a plurality of seats and a plurality of power units, each of the power units being mounted on the base, each of the seats being mounted on a corresponding one of the power units.

3. An article of furniture according to claim 2 wherein the plurality of seats each provide movement independent from movement of other seats in the same article of furniture.

4. An article of furniture according to claim 1 further comprising a back supported on at least one of the armrest pedestals.

5. An article of furniture according to claim 4, wherein the seat is moveable independent of the back.

6. An article of furniture according to claim 1 further comprising a back connected to the seat, whereby movement of the back is dependent on movement of the seat.

7. An article of furniture according to claim 1 wherein the article of furniture includes at least one throwbar supported by and structurally stabilizing the armrest pedestals.

8. An article of furniture according to claim 1 wherein at least one of the armrest pedestals includes a pocket.

9. An article of furniture according to claim 1 wherein the base includes at least two longitudinal members extending between and supporting the armrest pedestals.

10. An article of furniture comprising:

a base;

at least one back;

at least one seat; and two or more armrest pedestals vertically mounted to a top of the base, the armrest pedestals including attached horizontal lids, the horizontal lids being movable from a first horizontal closed position to a second horizontal open position while the lids remain at all times horizontal.

11. An article of furniture according to claim 10 wherein the attached lids are held horizontal during movement by two or more pivot hinges.

12. An article of furniture according to claim 11 wherein the armrest pedestals include a hollow interior, the hollow interior being exposed by movement of the attached lids.

13. The article of furniture according to claim 11 wherein the attached lid is at an elevation in the open position which is substantially the same as its elevation in the closed position.

14. An article of furniture for home or office use comprising:

a base configured to support a power seating unit above a floor of a building;

a power seating unit mounted on the base; and a seat mounted on and wholly supported by the power seating unit, the power seating unit providing selective, independent forward and rearward movement of the seat, selective, independent upward and downward movement of the seat, selective, independent movement of the seat about a horizontal axis, and any combination thereof.

15. The article of furniture of claim 14 further comprising two armrest pedestals mounted on and wholly supported by the base at opposite ends thereof.

16. The article of furniture of claim 15, wherein the base is comprised of a plurality of longitudinally extending members and a plurality of transverse members attached to the longitudinal members, and wherein the power seating unit and pedestals are mounted directly to at least one of the longitudinal or transverse members.

* * * * *